US006334467B1

(12) United States Patent
Barrett et al.

(10) Patent No.: US 6,334,467 B1
(45) Date of Patent: Jan. 1, 2002

(54) FORMING FABRIC

(75) Inventors: Rex Barrett, Peachtree City, GA (US); Dale B. Johnson, Ottawa; Rick Stone, Carleton Place, both of (CA)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/456,315

(22) Filed: Dec. 8, 1999

(51) Int. Cl.[7] ..... D03D 23/00

(52) U.S. Cl. ..... 139/383 A; 139/383 R; 139/358 AA; 162/903; 162/902; 162/358.2; 162/358.1; 442/181

(58) Field of Search ..... 139/383 A, 383 R, 139/358 AA; 162/903, 902, 358.2, 358.1; 442/181

(56) References Cited

U.S. PATENT DOCUMENTS

| | | | |
|---|---|---|---|
| 5,152,326 | A | 10/1992 | Vöringer |
| 5,518,042 | A | 5/1996 | Wilson |
| 5,520,225 | A | 5/1996 | Quigley et al. |
| 5,542,455 | A | 8/1996 | Ostermayer et al. |
| 5,564,475 | A | 10/1996 | Wright |
| 5,641,001 | A | 6/1997 | Wilson |
| 5,709,250 | A | 1/1998 | Ward et al. |
| 5,826,627 | A | 10/1998 | Seabrook et al. |
| 5,937,914 | A | 8/1999 | Wilson |

*Primary Examiner*—Stanley S. Silverman
*Assistant Examiner*—M. Halpern
(74) *Attorney, Agent, or Firm*—Robert A. Wilkes

(57) ABSTRACT

A flat woven papermaker's forming fabric having a paper side layer and a machine side layer interconnected by pairs of weft binder yarns. Each of the binder yarn pair members in sequence interweaves with a portion of the paper side layer warp yarns in segments of the weft yarn path so as to complete an unbroken weft path in the paper side layer weave pattern, and to provide an internal paper side layer float. Each of the binder yarn pair floats interlaces with a machine side layer warp yarn so as to bind the paper and machine side layers together. To recess the binder yarns from the plane of fabric wear the interlacing point is located at or near the midpoint of an internal float in the machine side layer warp yarn. The number of paper side layer weft yarns located between each of the pairs of intrinsic weft yarns is irregular within one repeat of the overall fabric weave pattern. The location of the paper side layer internal floats also determines the interlacing locations with the machine side layer. A wider choice of possible paper and machine side layer weave design combinations than was previously possible is thus made available in forming fabrics including weft binder yarn pairs, thereby allowing for a better match between the fabric and the paper maker's requirements.

23 Claims, 12 Drawing Sheets

Fig. 3

| | Paper Side Layer Warp Yarns | | | | | | | | | | | | | |
|---|---|---|---|---|---|---|---|---|---|---|---|---|---|---|
| 1 | | | | | | | | | | | | | | |
| BP | | | Z | | | X | | | Z | | | X | | |
| BP | | | X | | | Z | | | X | | | Z | | |
| 2 | | | | | | | | | | | | | | |
| 1 | | | | | | | | | | | | | | |
| BP | | X | | | Z | | | X | | | Z | | | X |
| 1 | | | | | | | | | | | | | | |
| BP | Z | | | X | | | Z | | | X | | | Z | |
| BP | X | | | Z | | | X | | | Z | | | X | |
| 1 | | | | | | | | | | | | | | |
| BP | | Z | | | X | | | Z | | | X | | | Z |
| 1 | | | | | | | | | | | | | | |

Fig. 5

| | Paper Side Layer Warp Yarns | | | | | | | | | | | | | | | |
|---|---|---|---|---|---|---|---|---|---|---|---|---|---|---|---|---|
| BP | | Z | | | X | | | Z | | | X | | | Z | | |
| 1 | | | | | | | | | | | | | | | | |
| BP | | T | X | | | Z | | T | X | | | Z | | T | X | |
| 1 | | | | | | | | | | | | | | | | |
| 2 | | | | | | | | | | | | | | | | |
| 3 | | | | | | | | | | | | | | | | |
| BP | T | X | | | Z | | T | X | | | Z | | T | X | | |
| 1 | | | | | | | | | | | | | | | | |
| BP | | | X | | | Z | | | X | | | Z | | | X | |
| 1 | | | | | | | | | | | | | | | | |
| 2 | | | | | | | | | | | | | | | | |
| 3 | | | | | | | | | | | | | | | | |
| BP | | Z | | | X | T | | Z | | | X | T | | Z | | |

Fig. 7

| | Paper Side Layer Warp Yarns | | | | | | | | | | | | | | |
|---|---|---|---|---|---|---|---|---|---|---|---|---|---|---|---|
| 1 | | | | | | | | | | | | | | | |
| BP | | | X | | | Z | | | X | | | Z | | | X |
| 4 | | | | | | | | | | | | | | | |
| 3 | | | | | | | | | | | | | | | |
| 2 | | | | | | | | | | | | | | | |
| 1 | | | | | | | | | | | | | | | |
| BP | | X | | | Z | | | X | | | Z | | | X | |
| 2 | | | | | | | | | | | | | | | |
| 1 | | | | | | | | | | | | | | | |
| BP | X | | | Z | | | X | | | Z | | | X | | |
| 2 | | | | | | | | | | | | | | | |
| 1 | | | | | | | | | | | | | | | |
| BP | | | Z | | | X | | | Z | | | X | | | Z |

Fig. 9

| | Paper Side Layer Warp Yarns | | | | | | | | | | | | | | |
|---|---|---|---|---|---|---|---|---|---|---|---|---|---|---|---|
| BP | | | Z | | | X | | | Z | | | X | | | Z |
| 3 | | | | | | | | | | | | | | | |
| 2 | | | | | | | | | | | | | | | |
| 1 | | | | | | | | | | | | | | | |
| BP | | X | | | Z | | | X | | | Z | | | X | |
| 2 | | | | | | | | | | | | | | | |
| 1 | | | | | | | | | | | | | | | |
| BP | | Z | | | X | | | Z | | | X | | | Z | |
| 1 | | | | | | | | | | | | | | | |
| BP | | | X | | | Z | | | X | | | Z | | | X |
| 3 | | | | | | | | | | | | | | | |
| 2 | | | | | | | | | | | | | | | |
| 1 | | | | | | | | | | | | | | | |
| BP | X | | | Z | | | X | | | Z | | | X | | |

FORMING FABRIC

FIELD OF THE INVENTION

The present invention relates to a flat woven papermaker's forming fabric having a paper side layer and a machine side layer interconnected by weft binder yarns. Each weft binder yarn in sequence interweaves with the paper side layer warp yarns in segments of the weft yarn path so as to complete the paper side layer weave pattern, and to contribute to the properties of the paper side surface of the paper side layer. Each weft binder yarn interlaces with a machine side layer warp yarn, to bind the paper and machine side layers together. Within the overall fabric weave pattern, the number of weft yarns between pairs of weft binder yarns in the paper side layer is irregular.

BACKGROUND OF THE INVENTION

Flat woven papermaker's forming fabrics in which so-called "intrinsic" weft binder yarn pairs are used to interconnect the weave structures of the paper and machine side layers are well known. Various arrangements have been described, for example by Wilson, U.S. Pat. No. 5,518,042; Vohringer, U.S. Pat. No. 5,152,326; Quigley et al., U.S. Pat. No. 5,520,225; Ostermayer et al., U.S. Pat. No. 5,542,455; Wright, U.S. Pat. No. 5,564,475; Wilson, U.S. Pat. No. 5,641,001; Ward, U.S. Pat. No. 5,709,250; Seabrook et al., U.S. Pat. No. 5,826,627; and Wilson, U.S. Pat. No. 5,937,914. Many others are known.

One feature that is common to all of these known forming fabric designs is that they are essentially "regular" and "even". The spacing of the intrinsic weft binder yarn pairs is regular there being the same number of paper side layer weft between each binder yarn pair, and the interlacing points of each member of the intrinsic weft binder pair into the machine side layer are evenly spaced in both the machine direction and cross-machine direction, within the fabric weave pattern repeat. Thus there is always one, or two, or even three wefts in between each intrinsic weft binder yarn pair.

These references also teach, for example in Seabrook et al. and in the two Wilson disclosures, that the two members of a weft binder yarn pair can occupy a single weft path in the paper side layer such that when one of the members interweaves into the paper side layer thus occupying one segment of the weft path, the other interlaces with a warp in the machine side layer. These disclosures also teach that there can be none, one, two, or three paper side layer warp yarns in between successive segments of the weft path.

As used herein, the following terms have the following meanings.

The term "weft binder yarn" refers to each yarn of a pair of yarns which together occupy a single unbroken weft path in the paper side layer, and which separately interlace with a machine side layer warp yarn.

The term "interweave" refers to a locus at which a yarn forms at least one knuckle with another yarn in the paper side layer.

The term "segment" refers to a locus at which a weft binder yarn interweaves with at least one paper side layer warp.

The term "interlace" refers to a point at which a yarn wraps about another yarn in the machine side layer to form a single knuckle.

The term "float" refers to that portion of a yarn which passes over, or under, a group of other yarns in the same layer of the fabric without interweaving or interlacing with them. The associated term "float length" refers to the length of a float, expressed as a number indicating the number of yarns passed over. A float can be exposed on the machine side or paper side of each of the paper side layer and the machine side layer. The term "internal float" thus refers to a float exposed between the two layers, either on the machine side of the paper side layer, or on the paper side of the machine side layer.

The terms "regular" and "irregular" refer to the number of wefts in between successive weft binder yarns in the paper side layer within the fabric weave pattern repeat. In a regular fabric, the number of intervening wefts is constant; in an irregular fabric the number of intervening wefts is not constant.

The terms "symmetry" and "asymmetry", and the associated terms "symmetrical" and "asymmetrical", refer to the shape of the path occupied by a weft binder yarn as it exits the paper side layer, interlaces with a machine side layer warp, and returns to the paper side layer. The path is symmetrical when the interlacing point is located substantially at the middle of the path.

The terms "even" and "uneven" refer to the location of the interlacing points between a weft binder yarn and a machine side layer warp in the machine side layer within the fabric weave pattern repeat. In an "even" fabric the points are all the same distances apart in each of the machine direction and the cross machine direction and form a coherent pattern; in an "uneven" fabric the points are not necessarily all the same distances apart in the machine direction and do not form a coherent pattern.

The notation such as 3/2, for example, in reference to a fabric design refers to the number of warp, or machine direction yarns, over and under which a weft, or cross machine direction yarn, floats within the weave pattern. Thus 3/2 means that a weft yarn floats over three warp yarns and then under two warp yarns within the weave pattern.

Prior to the present invention, the basic approach in fabrics of this type has been to limit the designs chosen for each of the paper side layer and machine side layer to those which were compatible for interconnection with each other. For the two chosen designs to be compatible, two criteria were considered to be important.

First, it must be possible to weave the complete fabric incorporating the designs chosen for the paper side layer and the machine side layer, and including the weft binder yarns which interconnect the two layers together, on one loom. Generally, the number of sheds required to weave the machine side layer when divided by the number of sheds required to weave the paper side layer is an integer, typically 1, 2 or 3. Occasionally, this ratio will be a fraction, such as ½, when a 3-shed machine side layer design is combined with a 6-shed paper side layer design. In general, the number obtained by dividing the higher shed number by the lower one will be an integer.

Second, the paper side layer and machine side layer weave designs must provide internal weft floats (paper side layer) and internal warp floats (machine side layer) which can be interlaced to interconnect the two layers without creating any significant stresses which will distort the planarity of either or both layers. As noted above, this approach resulted in fabrics which are both regular and even. It was also believed that other properties of a forming fabric, such as planar fibre support and wire marking, would be adversely affected if the weft binder pairs were irregularly spaced.

It was generally believed that these limitations would maximise fabric stability, reduce or even eliminate sleaziness (the movement of one of the two layers relative to the other) and reduce the occurrence of fabric delamination caused by both internal and external abrasion of the weft binder yarns.

It is thus apparent that a great deal of experimental and design effort had to be expended in order to find compatible combinations of paper and machine side layer weave designs capable of interconnection by means of weft binder yarns, because the number of compatible paper and machine side layer weave design combinations available for use in forming fabrics of this type has been restricted by the criteria noted above.

BRIEF SUMMARY OF THE INVENTION.

This invention is based on the discovery that regularity is not a necessity in forming fabrics of this type. From this it follows that weft binder yarn pairs can be irregularly arranged in the paper side layer, so that within the weave pattern repeat the number of weft between each weft binder yarn pair is not always the same. Since the locations of the internal floats in the weft binder yarns within the paper side layer pattern repeat will determine the interlacing locations, it also follows that the interlacing points in the machine side layer can be selected so as to match the requirements of the paper side layer weave design and need not always be evenly arranged. Conversely, it is also possible to select the machine side layer weave design, then select the paper side layer and then select the interlacing points. It has been discovered that under these conditions it is possible to choose the interlacing locations so that out of plane stresses can be at least reduced, if not substantially eliminated. By introducing irregularity into the paper side layer weave pattern repeat, a much broader range of paper side layer and machine side layer design combinations becomes available, because the fabric designer now has greater freedom to select appropriate paper side layer and machine side layer interlacing point locations, based on the paper side layer and machine side layer weave designs.

In the fabrics of this invention, internal weft floats are provided in the paper side layer, and internal warp floats are provided in the machine side layer. During weaving, these floats are interlaced as desired within the confines of the designs chosen for each of the two layers. There are three parameters which determine the fabric weave pattern. First, the paper side layer weft binder yarn internal float should be as long as possible. Second, the path of the weft binder yarn internal float should be as symmetrical as possible about the interlacing point with the machine side layer internal warp yarn float. Third, in order to protect the weft binder yarn from abrasion, the interlacing point should be as close as possible to the middle of the machine side layer internal warp yarn float.

A second concept used in this invention is that all of the paper side layer weft yarns are substantially the same size. Although some are doubled as weft binder yarn pairs, only one pair member at a time occupies each segment in the unbroken weft path and therefore all of the weft binder yarns contribute to the properties of the paper side layer of the fabric.

Within these broad constraints, it is possible to create a forming fabric in which the weft yarns chosen as weft binder yarns are irregularly spaced.

It is thus apparent that the interlacing locations of the paper side layer and machine side layer internal floats in the fabrics of this invention should be chosen with some care. The limitation on both of these floats appears to be that each should be as long as is reasonably possible within the constraints of the two weave designs. For example, in its path in between the two layers, the paper side float has essentially a "V" shape: as the float length increases, the V is flattened reducing the out of plane stresses imposed on the paper side layer. In a similar way, if the V shaped path is not symmetrical, and the interlacing point is close to one end of the float, or the float is relatively short, any stresses imposed on the paper side layer are increased at the shorter end of the float. Similarly, to maximise the protection of the interlacing point, and remove it as far as is practicable from the machine side layer wear plane, the machine side layer internal float should be as long as possible. The upper limits on these two float lengths cannot be directly determined.

STATEMENT OF THE INVENTION.

The present invention seeks to provide a papermaker's forming fabric comprising in combination a paper side layer including a first set of warp and weft yarns, in which the weft yarns include weft binder yarns, interwoven according to a first pattern which provides for internal floats of the paper side layer weft binder yarns, a machine side layer including a second set of warp and weft yarns interwoven according to a second pattern which provides for internal floats of the machine side layer warp yarns, wherein within the fabric weave pattern repeat:

(i) the weft binder yarns in pairs together occupy successive segments of an unbroken weft path within the paper side layer;

(ii) the paper side layer weft binder yarn internal floats interlace with machine side layer internal warp yarn floats; and (iii) the number of paper side layer weft yarns between the weft binder yarns is irregular.

Preferably, each weft binder yarn interlaces at or near to the midpoint of an internal machine side layer warp yarn float.

Preferably, within the pattern repeat, each machine side layer warp yarn interlaces once with a paper side layer weft binder yarn.

Preferably, the path occupied by each weft binder yarn, as it passes from interweaving with the paper side layer warp yarns in a segment of the paper side layer weft yarn path to interlace with a machine side layer warp yarn internal float and return to interweave with the paper side layer warp yarns in another segment of the paper side layer weft yarn path, is more or less symmetrical about the interlacing point.

Preferably, the machine side layer warp yarn internal float length is at least two, and more preferably is at least three. Most preferably, the machine side layer warp yarn float length is four or more.

Preferably, the paper side layer is woven according to a weave design chosen from the group consisting of: a plain weave, a 2/1 twill, a 2/1 broken twill, a 2/1 satin, a 2/2 basket weave, a 2/2 twill, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, and a 5/1 satin.

Preferably, the machine side layer is woven according to a weave design chosen from the group consisting of: a plain weave, a 2/1 twill, a 2/1 broken twill, a 2/1 satin, a 2/2 basket weave, a 3/1 twill, a 3/1 broken twill, a 3/1 satin, a 3/2 twill, a 3/2 satin, a 3/3/twill, a 4/1 twill, a 4/1 broken twill, a 4/1 satin, a 5/1 twill, a 5/1 broken twill, a 5/1 satin, and an N×2N design as disclosed by Barrett in U.S. Pat. No. 5,544,678.

Preferably, the ratio of the number of paper side layer weft yarns to the number of machine side layer weft yarns is chosen from the group consisting of: 1:1, 3:2, 5:3, 2:1 or 3:1, when the weft binder yarns are included, and a pair of weft binder yarns counted as one paper side layer weft yarn.

Preferably, the ratio of the number of paper side layer warp yarns to the number of machine side layer warp yarns is 1:1. Alternatively, the ratio of the number of paper side layer warps to the number of machine side layer warps is 2:1.

Both the machine and paper side layers may be woven according any known weave design which would be acceptable for the intended use of the fabric. However, we have found that the machine side layer should be woven according to a design which provides for an internal warp float length of at least three. Although the principles of this invention are equally applicable to nearly all known designs, they are especially applicable to designs whose machine side layer internal warp float lengths are at least 4 or more. This is because in designs which have frequent machine side layer interlacing locations, and which are woven according to designs which provide float lengths of one (plain weave), or two (2/1 satins, twills or broken twills), although there are a large number of locations that may be utilized for interlacing, none of them provide more than minimal protection for the weft binder yarn. Although the invention can be practiced with a combination of plain weave as each of the paper and machine side layer weave designs, its greatest applicability is to machine side layer weave designs which have longer internal float lengths, where it is possible to find acceptable interlacing locations at which the weft binder yarn can be protected from wear. When the forming fabric is to be used for the manufacture of products such as tissue, towel and the like, machine side layer designs that provide shorter internal warp float lengths, such as a plain weave and a 2/1 twill, can be used.

Preferably, the fabrics of this invention have a 5/1 broken twill machine side layer weave which provides for a float length of five yarns, and one of either a 2/1 twill, satin or plain weave paper side layer design. The 5/1 broken twill machine side layer weave design has been found to be particularly useful, due to its wear resistance and long internal warp float length which allows the interlacing points to be recessed as much as possible.

BRIEF DESCRIPTION OF THE FIGURES

FIG. 3 is a schematic plot derived from FIG. 1 showing the location of the interlacing points;

FIG. 5 is a schematic plot derived from FIG. 4 showing the location of the interlacing points;

FIG. 7 is a schematic plot derived from FIG. 6 showing the location of the interlacing points;

FIG. 9 is a schematic plot derived from FIG. 8 showing the location of the interlacing points;

DETAILED DESCRIPTION OF THE FIGURES.

Figure 10:
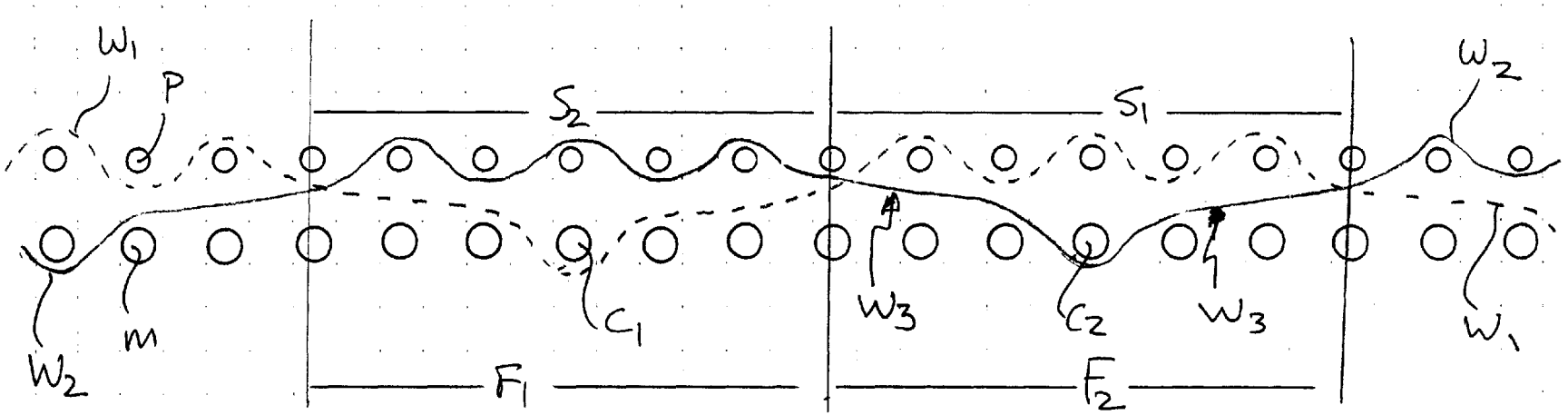
FIGS. 10 and 11 show respectively symmetrical and asymmetrical weft binder paths.
Figure 11:
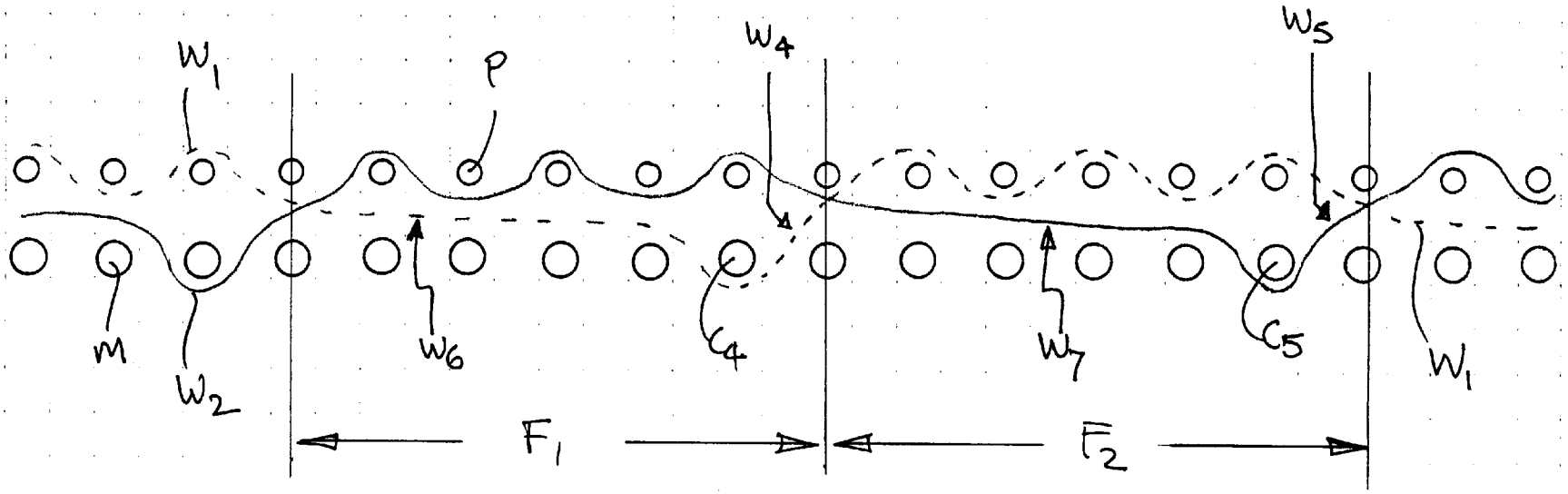
Figure 12:
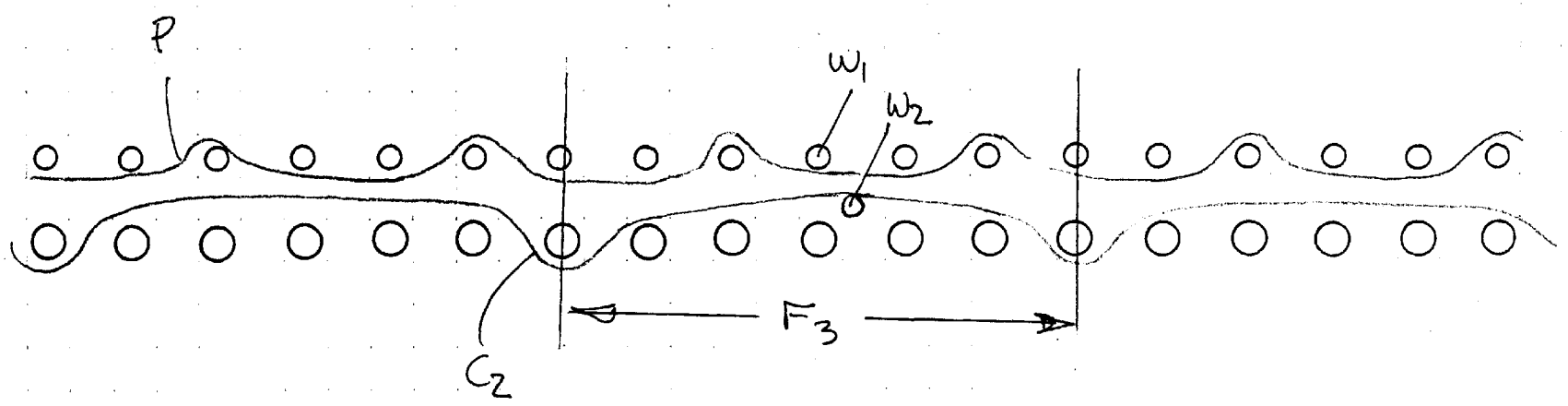
FIG. 12 shows a typical location for an interlacing point along a machine side layer warp.

Reference is made first to the schematic weave cross-section diagrams shown in FIGS. 10, 11 and 12 as these show some of the features of this invention which are utilised in the fabrics shown in the other embodiments.

In FIG. 10 the cross-section is taken substantially parallel to the paper side layer wefts $W_1$ and $W_2$ which together comprise a pair of binder yarns; the warps in both layers of the fabric, P in the paper side layer and M in the machine side layer, are shown in cross-section. In FIG. 10(and also in FIG. 11) the machine side layer weft yarn is omitted for clarity. The paper side layer weave pattern shown is a 1/1 plain weave. Within that weave, the pair of binder weft yarns $W_1$ and $W_2$ can be seen to occupy one unbroken weft path, so that although each of $W_1$ and $W_2$ in sequence interlace with the machine side layer warp yarn internal floats $C_1$ and $C_2$ there is no disturbance in the paper side layer weave. It can also be seen that the two wefts $W_1$ and $W_2$ each occupy the segments $S_1$ and $S_2$ of the unbroken weft path. The weave path for each of the two wefts $W_1$ and $W_2$ also provides internal floats $F_1$ and $F_2$. Interlacing of the weft binder yarns $W_1$ and $W_2$ with the machine side layer warps C, and $C_2$ binds the two layers together.

In this design, the two segments $S_1$ and $S_2$ have the same segment length, and are the same length as the internal floats $F_1$ and $F_2$ respectively, and the weft path in each of the floats is substantially symmetrical, because the machine side layer warps $C_1$ and $C_2$ are located more or less at the midpoint of the floats $F_1$ and $F_2$. The two parts $W_3$ of the path are each the same length either side of the machine side layer warp $C_2$ and within the float $F_2$. This is the ideal location, and is possible because the float is relatively long, and the number of machine side layer warps under the float is an odd number. If the number of warps under the float is an even number, then full symmetry is impossible, and the interlacing point generally will be located on one of the warps either side of the float midpoint.

Although the paper side layer weave design shown in FIG. 11 is the same plain weave as shown in FIG. 10, and the float and segment lengths are the same, the weft paths for the two binder yarns are different. The machine side layer warps $C_4$ and $C_5$ chosen for the interlacing points with the wefts $W_1$ and $W_2$ are asymmetrically located relative to the floats $F_1$ and $F_2$. This has the result that the two parts of the weft yarn path indicated at $W_4$ and $W_5$ require a relatively abrupt transition from the interlacing point up into the paper side layer. The other two parts of this path, indicated at $W_6$ and $W_7$, are still relatively gradual. Both parts of the weft path will become abrupt if the floats $F_1$ and $F_2$ are short. The disadvantage with this form of weft path is that it is apt to induce out of plane stresses in the paper side layer which cause dimples and the like in the forming fabric, which cannot always be accepted.

FIG. 12 shows schematically the interlacing of the machine side layer internal float with the paper side layer internal floats in the weft binder yarns $W_1$ and $W_2$; FIG. 12 is thus substantially parallel to the warps P and $C_2$ in FIG. 10. Successive pairs of paper side layer binder wefts $W_1$ and $W_2$ interlace in sequence with each of the internal floats in the machine side warp $C_2$. By placing the interlacing point near to the midpoint of the machine side layer float $F_3$ optimum protection from abrasive wear is afforded to the knuckle formed at the interlacing point. If the interlacing point is located nearer to the end of the machine side layer warp internal float, or if a short float is used, the level of protection is diminished, and out-of-plane stresses may be introduced which may distort the paper side layer.

The fabrics shown in the embodiments of FIGS. 1–9 will now be discussed. In these Figures, in both layers of the fabric the wefts are essentially across the Figure, and the warps at a right angle to them. In these Figures, as appropriate, non-binding paper side layer wefts between each pair of weft binder yarns are numbered 1, 2, . . . as required; paper side layer weft binder yarn pairs are numbered as 10 and 11, paper side layer warps are numbered 20, 21 . . . as required, machine side layer warps are numbered 30, 31 . . . as required, segment ends are numbered 40, 41 . . . as required, and interlacing points are numbered 50, 51 . . . as required.

Figure 1:
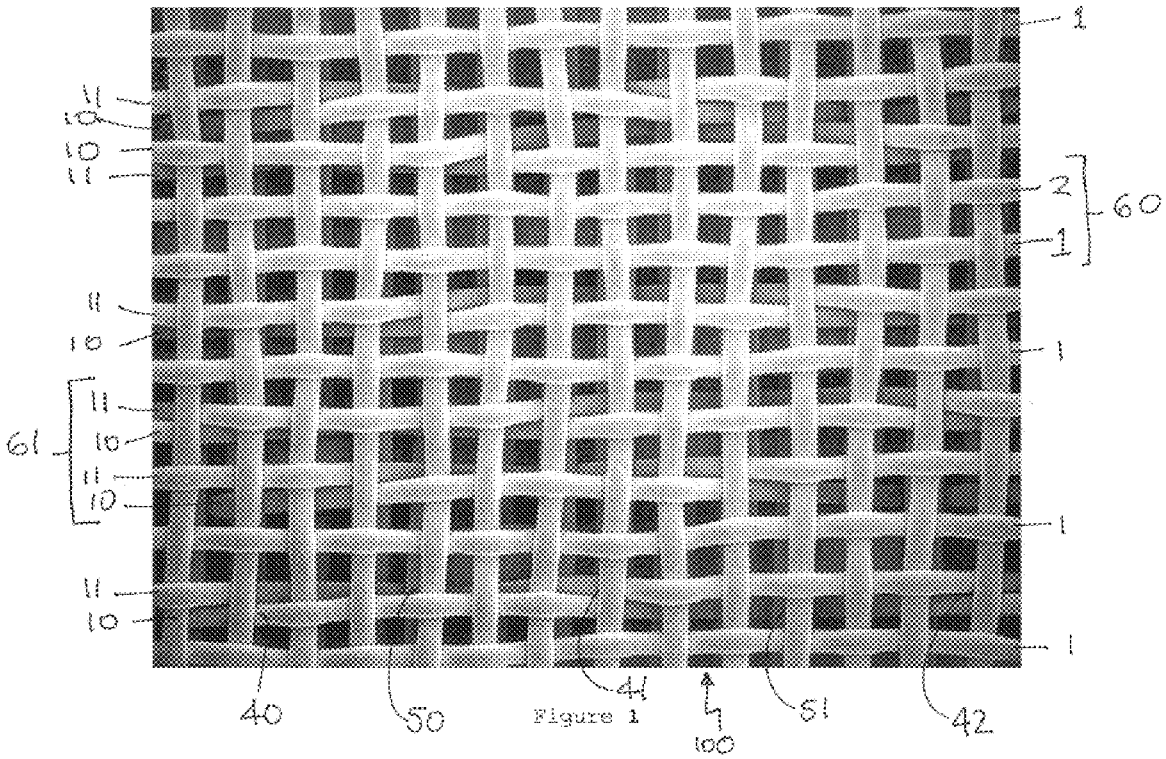
FIG. 1 is 22.5×magnification scanning electron microscope (SEM) photograph of the paper side surface of the paper side layer of a first embodiment of a fabric according to this invention.
Figure 2:
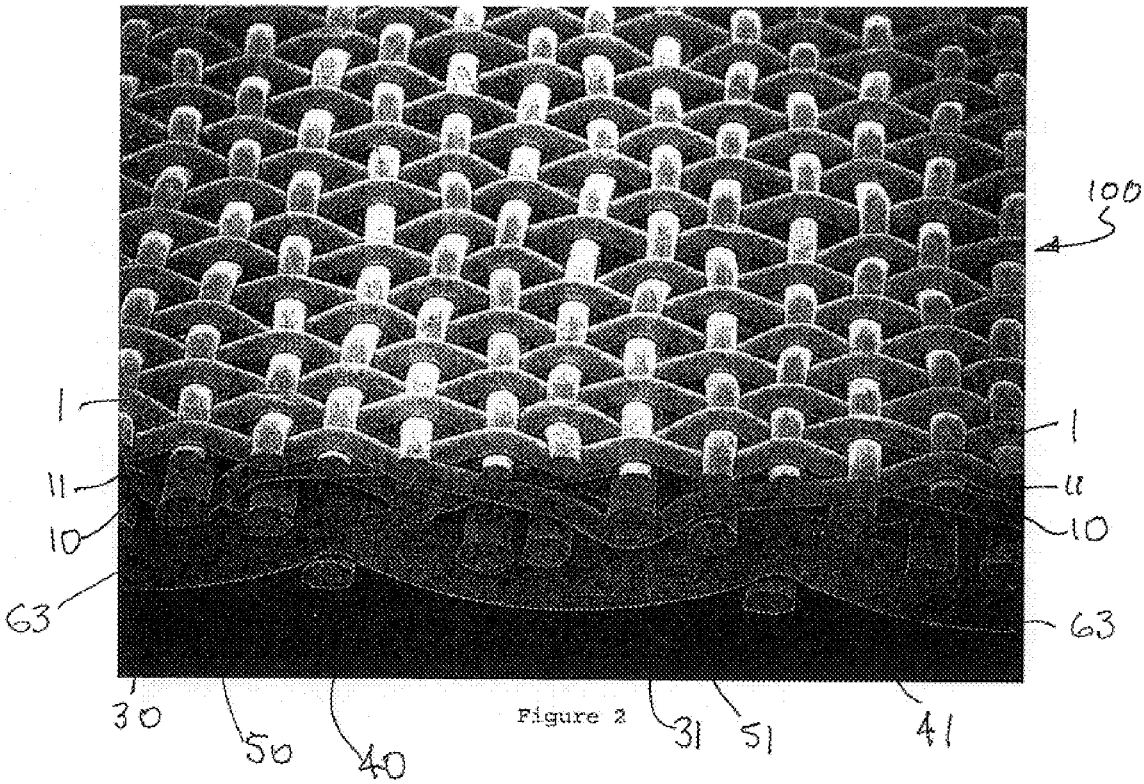
FIG. 2 is a 25×magnification SEM photograph of a weft cross section of the fabric shown in FIG. 1 showing a pair of weft binder yarns.

FIGS. 1 and 2 show two views of a first embodiment of the invention. In this fabric, the paper side layer is a 1/1 plain weave, and the machine side layer is a 5/1 broken twill pattern in which the warps provide the required internal floats.

FIG. 1 is a 22.5×magnification photograph of the paper side surface of the paper side layer. Typical locations at which the pairs of binder yarns exchange positions in the paper side layer weave can be seen at 40, 41 and 42: while member 10 interweaves with the paper side layer warps in a first segment from 40 to 41, the other member 11 forms an internal float, between the paper side layer and the machine side layer(see FIG. 2), and interlaces with a machine side layer warp as at 50. Similarly, the member 11 interweaves with the paper side layer warps in the next segment from 41 to 42, and the member 10 interlaces with a machine side layer warp at 51. Although the weft binder yarns always comprise a pair of yarns, the number of non-binding wefts in this fabric is not constant: as shown by the numbering of these non-binding yarns in FIG. 1 at 60 there are two non-binding yarns 1 and 2 between two successive pairs of weft binder yarns, and at 61 there is no intervening non-binder yarn at all. It can thus be seen that the sequence of binding and non-binding yarns is irregular.

FIG. 2 is a 25×magnification photograph, taken along a cross-section of a weft binder yarn pair, showing the paths of the pair members. Starting at the left, member 11 interweaves with a group of paper side layer warps in a first segment, which ends at 40 where the two members 10 and 11 exchange positions. Member 11 then proceeds downwardly at a shallow angle into the machine side layer, to interlace with a machine side layer warp 31 at 51. Thereafter member 11 proceeds upwardly at a shallow angle to the segment end at 41, where it again interchanges positions with the member 10. Member 10 occupies a similar path and can be seen to interlace with a machine side layer warp 30 at 50. FIG. 2 also shows how the interlacing points can be deeply recessed into the machine side layer away from the wear plane, which is essentially defined by the machine side surface of the machine side layer weft 63.

From a comparison of FIGS. 1 and 2 one feature of this invention becomes apparent. It can be seen in FIG. 2 that the paper side layer internal floats formed in each member of the weft binder yarn pairs always interlace with a machine side layer warp float: these interlacing points have to be more or less under the midpoint of the weft path segment in the paper side layer occupied by the other member of the pair. In this weave design, this position is also more or less under the midpoint of the segment, as the interlacing is chosen to be at the midpoint of the internal weft binder float. It then follows that the available interlacing points are determined by either the location of the segments in the paper side layer, or by the location of the midpoints of the internal warp floats.

On this basis, it is possible to derive from FIG. 1 the schematic plot of FIG. 3. In this plot, the paper side layer wefts are across the plot, and are identified as in FIG. 1, except that the notation "BP" indicates a weft binder pair. The paper side layer warps are at a right angle to the wefts. The points marked X correlate to the midpoint of all of the segments visible in FIG. 1, and the points marked Z correlate to the segment ends. It can be seen from FIG. 3 that although all of these interlacing points are the same distance apart in the weft direction, the pattern is uneven, and has visible empty spaces along the warps where there are no interlacing points at all. It can thus be seen that totally unlike the known fabrics of this type, the interlacing points are not evenly spaced, and do not form a coherent pattern.

In the fabric illustrated in FIGS. 1 and 2, the ratio of the number of warps in the paper side layer to the number of warps in the machine side layer is 1:1, while the ratio of the number of paper side layer weft yarns (counting each pair of intrinsic weft binder yarns as one yarn) to the number of machine side layer weft yarns is 2:1. The fabric was woven according to a 24-shed pattern, using round polyester yarns. The fabric parameters were as follows:

Paper side layer warp: 0.13 mm
Machine side layer warp: 0.21 mm
Paper side layer weft: 0.13 mm
Machine side layer weft: 0.33 mm
Mesh count, paper side layer: 27.5×29.5/cm.
Mesh count, machine side layer: 27.5×29.5/cm
Mesh count, finished fabric: 55×59/cm.

A single yarn size was used for all of the paper side layer weft, both binding and non-binding. In the paper side layer mesh count pairs of binder weft yarns are counted as one yarn.

Figure 4:
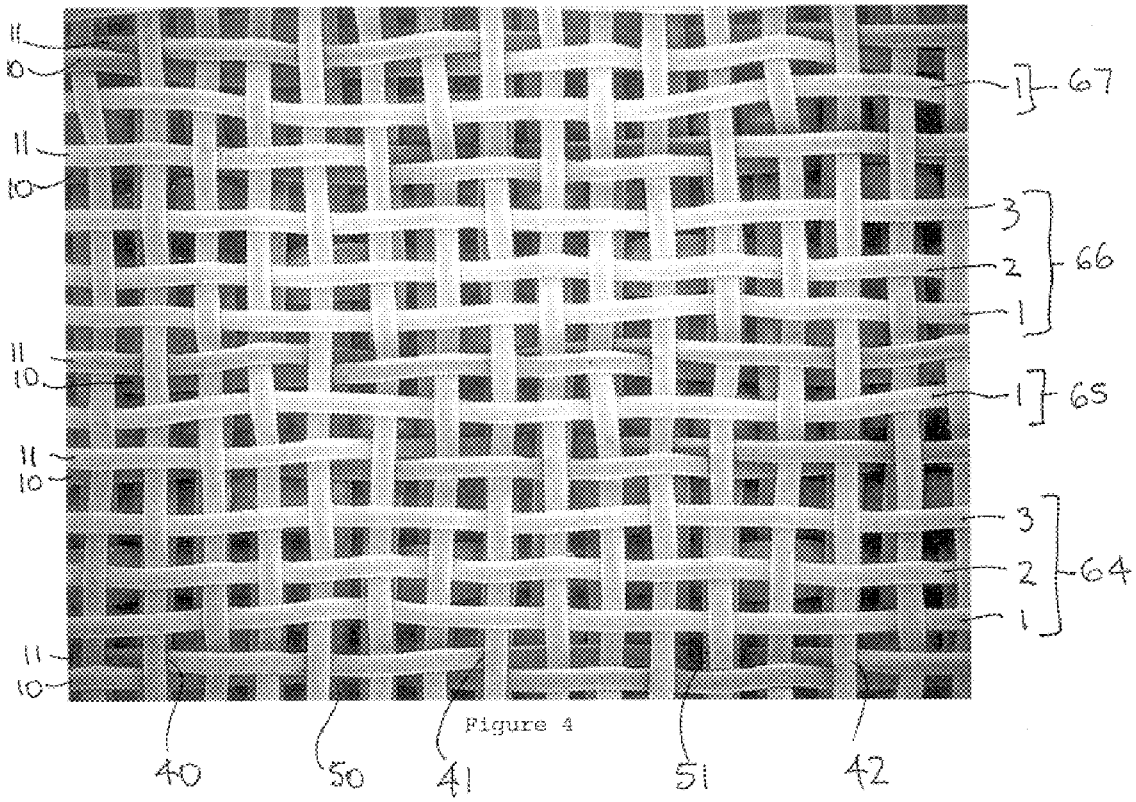
FIG. 4 is a 20×magnification SEM photograph of the paper side surface of a second embodiment of a fabric woven according to this invention.

FIGS. 4 and 5 show the details of a second embodiment of a fabric woven according to this invention. In this fabric, the paper side layer is a 2/1 twill weave, and the machine side layer is a 5/1 broken twill pattern in which the warps provide the required internal floats.

FIG. 4 is a 20×magnification photograph of the paper side surface of the paper side layer. Typical locations at which the pairs of binder yarns exchange positions in the paper side layer weave can be seen at 40, 41 and 42: while member 11 interweaves with the paper side layer warps in a first segment from 40 to 41, the other member 10 forms an internal float, between the paper side layer and the machine side layer and interlaces with a machine side layer warp as at 50. Similarly, the member 10 interweaves with the paper side layer warps in the next segment from 41 to 42, and the member 11 interlaces with a machine side layer warp at 51. Although the weft binder yarns always comprise a pair of yarns, the number of non-binding wefts in this fabric is not constant: at 64 there are three non-binding yarns, at 65 there is only one, at 66 there are again three, and at 67 again only one. Comparison with FIG. 1 also shows that in this fabric at no point are two pairs of weft binder yarns placed side by side. It can thus be seen that the sequence of binding and non-binding yarns is irregular.

FIG. 5 is derived from FIG. 4 using the same concepts as for FIG. 3; the plot is arranged the same way, using the same letters. In this plot there is a further letter, which is T. This letter identifies the locations where the interlacing point is not located beneath the segment midpoint X, but to one side of it. The shift of the interlacing point from X to T is required in this weave pattern so that all of the interlacing points are located at the midpoint of a machine side layer warp internal float. This shift also requires that the binder weft yarn member path at these points is asymmetrical. In this design, the fact that the path is asymmetrical does not appear to generate significant out-of-plane stresses in the paper side layer, as there are still enough paper side layer warps between the interlacing location and the segment end to avoid an abrupt transition. It can be seen that the interlacing points X do not follow a coherent pattern.

The fabric shown in FIG. 4 was woven using the same warp and weft yarn sizes and mesh counts as those used for the fabric of FIG. 1. The ratio of the number of warps in the paper side layer to the number of warps in the machine side layer is 1:1, while the ratio of the number of paper side layer weft yarns (counting each pair of intrinsic weft binder yarns as one yarn) to the number of machine side layer weft yarns is 3:2.

Two further features of this invention are shown in this plot.

Inspection of the plot shows that at some points the T is one side of X, and at some points it is the other, and that this is achieved without any interference in the unbroken weft path occupied by the weft binder pairs in the paper surface of the paper side layer.

In theory, it is possible to avoid an asymmetric weft binder yarn path in this design by shifting the segment end points across the weave in either direction, because moving the segment end points does not interfere with the unbroken weft path occupied by the weft binder yarn pairs in the paper side layer weave pattern. However, if that step is taken with this paper side layer weave design, movement of the binder yarn segment ends for some of the binder yarn pairs by one paper side layer warp to move the interlacing point to the middle of the weft binder yarn internal float will also move the unbroken weft path out of registration with the adjacent weft yarns, thus introducing a level of randomness into the paper side surface of the paper side layer. In order to maintain registration, the segment ends have to be moved by three warps. This lack of registration after movement by one warp is a consequence of the 2/1 design used for the paper side layer weave pattern. It can occur in other paper side layer weave designs if the binder yarn segment ends are moved to get the best locations on both internal yarn floats for the interlacing points. This randomness is not always acceptable in a forming fabric surface, and can affect paper quality.

An alternative approach which can also be used to alleviate or avoid out-of-plane stresses in some paper side layer weave designs is that instead of shifting the segment end points, the segments can be of different lengths. For example, if the two segments together occupy an unbroken weft path requiring fourteen paper side layer warps (See FIG. 2), the two segments do not have to be of equal lengths, requiring seven warps each: a combination of eight and six will sometimes be found advantageous.

Figure 6:
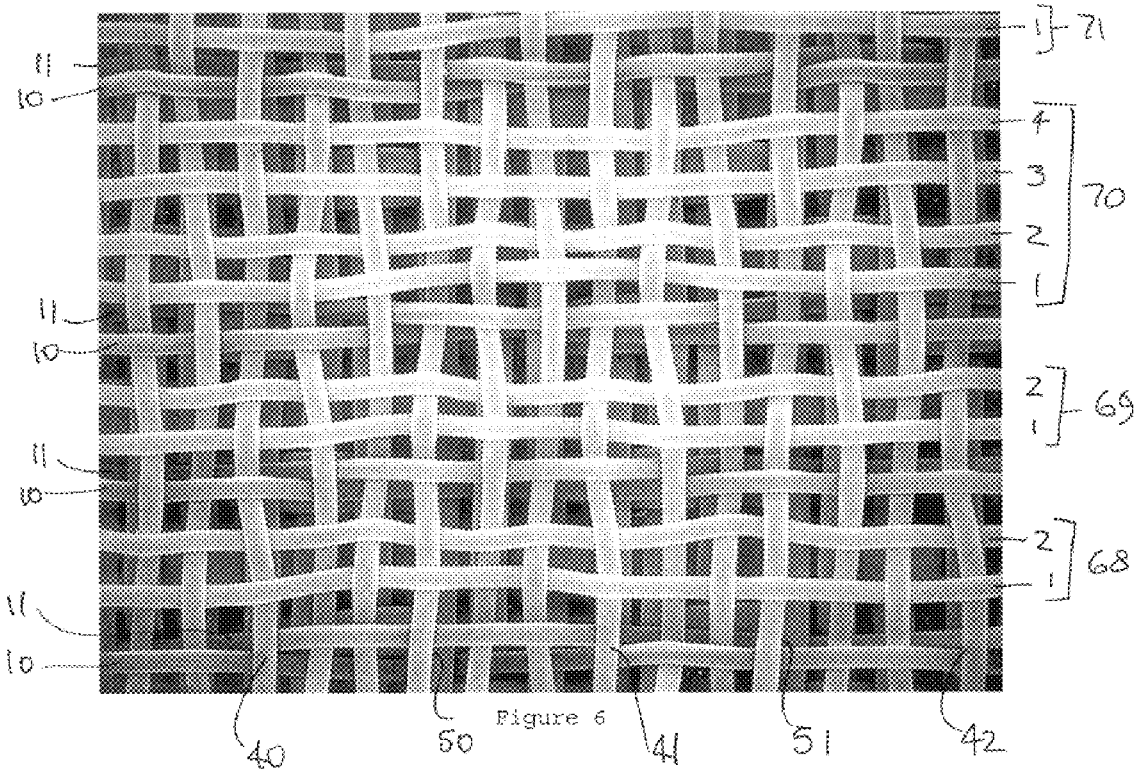
FIG. 6 is a 20×magnification SEM photograph of the paper side surface of a third embodiment of a fabric woven according to this invention.

FIGS. 6 and 7 show the details of a third embodiment of a fabric woven according to this invention. In this fabric, the paper side layer is a 2/1 broken twill weave, and the machine side layer is a 5/1 broken twill pattern in which the warps provide the required internal floats. The fabric shown in FIG. 6 was woven using the same warp and weft yarn sizes and mesh counts as those used for the fabric of FIG. 1. The ratio of the number of warps in the paper side layer to the number of warps in the machine side layer is 1:1, while the ratio of the number of paper side layer weft yarns (counting each pair of intrinsic weft binder yarns as one yarn) to the number of machine side layer weft yarns is 3:2.

FIG. 6 is a 20×magnification photograph of the paper side surface of the paper side layer. Typical locations at which the pairs of binder yarns exchange positions in the paper side layer weave can be seen at 40, 41 and 42: while member 11 interweaves with the paper side layer warps in a first segment from 40 to 41, the other member 10 forms an internal float, between the paper side layer and the machine side layer and interlaces with a machine side layer warp at 50. Similarly, the member 10 interweaves with the paper side layer warps in the next segment from 41 to 42, and the member 11 interlaces with a machine side layer warp at 51. Although the weft binder yarns always comprise a pair of yarns, the number of non-binding wefts in this fabric is not constant: at 68 and 69 there are two non-binding yarns, and at 70 there are four. Comparison with FIG. 1 also shows that in this fabric at no point are two pairs of weft binder yarns placed side by side. It can thus be seen that the sequence of binding and non-binding yarns is irregular.

FIG. 7 is derived from FIG. 5 using the same concepts as for FIG. 3; the plot is arranged the same way, using the same letters. In this fabric, all of the interlacing points are located at the midpoints of the segments, and at the midpoints of the machine side layer warp floats. It can be seen that the interlacing points X do not follow a coherent pattern.

Figure 8:
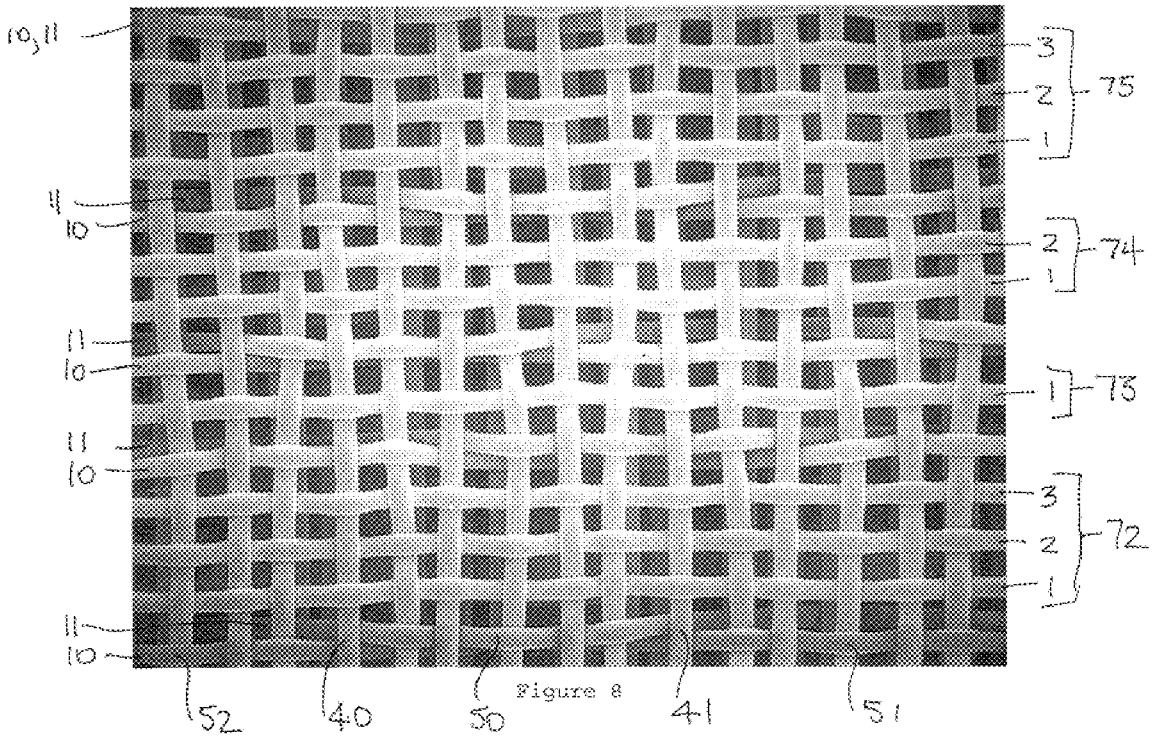
FIG. 8 is a 20×magnification SEM photograph of the paper side surface of a fourth embodiment of a fabric woven according to this invention.

FIGS. 8 and 9 show the details of a fourth embodiment of a fabric woven according to this invention. In this fabric, the paper side layer is a 1/1 plain weave, and the machine side layer is a 5/1 broken twill pattern in which the warps provide the required internal floats.

FIG. 8 is a 20×magnification photograph of the paper side surface of the paper side layer. Typical locations at which the pairs of binder yarns exchange positions in the paper side layer weave can be seen at 40 and 41: in between these points while member 11 interweaves with the paper side layer warps in a first segment, the other member 10 forms an internal float, between the paper side layer and the machine side layer and interlaces with a machine side layer warp at 50. Either side of this segment, the member 10 interweaves with the paper side layer warps in the adjacent segments, and the member 11 interlaces with machine side layer warps at 51 and 52. Although the weft binder yarns always comprise a pair of yarns, the number of non-binding wefts in this fabric is not constant: at 72 there are three non-binding yarns, at 73 there is only one, at 74 there are two, and at 75 there are three. Comparison with FIG. 1 also shows that in this fabric at no point are two pairs of weft binder yarns placed side by side, even though the same paper side layer weave design is used. It can thus be seen that the sequence of binding and non-binding yarns is irregular.

FIG. 9 is derived from FIG. 8 using the same concepts as for FIG. 3; the plot is arranged the same way, using the same letters. In this fabric, all of the interlacing points are located at the midpoints of the segments, and at the midpoints of the machine side layer warp floats. It can be seen that the interlacing points do not follow a coherent pattern.

In the fabric illustrated in FIG. 8, the ratio of the number of warps in the paper side layer to the number of warps in the machine side layer is 1:1, while the ratio of the number of paper side layer weft yarns (counting each pair of intrinsic weft binder yarns as one yarn) to the number of machine side layer weft yarns is 3:1. The fabric was woven using round polyester yarns. The fabric parameters were as follows:

Paper side layer warp: 0.13 mm

Machine side layer warp: 0.21 mm

Paper side layer weft: 0.13 mm

Machine side layer weft: 0.33 mm

Mesh count, paper side layer: 27.5×29.5/cm.

Mesh count, machine side layer: 27.5×9.8/cm

Mesh count, finished fabric: 55×41.3/cm. A single yarn size was used for all of the paper side layer weft, both binding and non-binding. In the paper side layer mesh count pairs of binder weft yarns are counted as one yarn.

What is claimed is:

1. A papermaker's forming fabric comprising in combination a paper side layer including a first set of warp and weft yarns, in which the weft yarns include weft binder yarns, interwoven according to a first pattern which provides for internal floats of the paper side layer weft binder yarns, a machine side layer including a second set of warp and weft yarns interwoven according to a second pattern which provides for internal floats of the machine side layer warp yarns, wherein within the fabric weave pattern repeat:

(i) the weft binder yarns in pairs together occupy successive segments of an unbroken weft path within the paper side layer;

(ii) the paper side layer weft binder yarn internal floats interlace with machine side layer internal warp yarn floats; and (iii) the number of paper side layer weft yarns between the weft binder yarns is irregular.

2. A forming fabric according to claim 1 wherein each weft binder yarn interlaces at or near to the midpoint of an internal machine side layer warp yarn float.

3. A forming fabric according to claim 1 wherein the successive segments of the unbroken weft path occupied by the pairs of weft binder yarns are the same length.

4. A forming fabric according to claim 1 wherein the successive segments of the unbroken weft path occupied by the pairs of weft binder yarns are not the same length.

5. A forming fabric according to claim 1 wherein within the pattern repeat, each machine side layer warp yarn interlaces once with a paper side layer weft binder yarn.

6. A forming fabric according to claim 1 wherein the path occupied by each weft binder yarn, as it passes from interweaving with the paper side layer warp yarns in a segment of the paper side layer weft yarn path to interlace with a machine side layer warp yarn internal float and return to interweave with the paper side layer warp yarns in another segment of the paper side layer weft yarn path, is more or less symmetrical about the interlacing point.

7. A forming fabric according to claim 1 wherein the path occupied by each weft binder yarn, as it passes from interweaving with the paper side layer warp yarns in a segment of the paper side layer weft yarn path to interlace with a machine side layer warp yarn internal float and return to interweave with the paper side layer warp yarns in another segment of the paper side layer weft yarn path, is asymmetrical about the interlacing point.

8. A forming fabric according to claim 1 wherein the machine side layer warp yarn internal float length is at least two.

9. A forming fabric according to claim 1 wherein the machine side layer warp yarn internal float length is at least three.

10. A forming fabric according to claim 1 wherein the machine side layer warp yarn float length is four.

11. A forming fabric according to claim 1 wherein the machine side layer warp yarn float length is more than four.

12. A forming fabric according to claim 1 wherein the paper side layer is woven according to a weave design chosen from the group consisting of: a plain weave, a 2/1 twill, a 2/1 broken twill, a 2/1 satin, a 2/2 basket weave, a 2/2 twill, a 3/1 twill, a 3/1 broken twill, a 3/1 satin, a 3/2 twill, a 3/2 satin, a 4/1 twill, a 4/1 broken twill, a 4/1 satin, a 5/1 twill, a 5/1 broken twill, and a 5/1 satin.

13. A forming fabric according to claim 1 wherein the machine side layer is woven according to a weave design chosen from the group consisting of: a plain weave, a 2/1 twill, a 2/1 broken twill, a 2/1 satin, a 2/2 basket weave, a 3/1 twill, a 3/1 broken twill, a 3/1 satin, a 3/2 twill, a 3/2 satin, a 3/3/twill, a 4/1twill, a 4/1 broken twill, a 4/1 satin, a 5/1 twill, a 5/1 broken twill, a 5/1 satin, and an N×2N design as disclosed by Barrett in U.S. Pat. No. 5,544,678.

14. A forming fabric according to claim 1 wherein the ratio of the number of paper side layer weft yarns to the number of machine side layer weft yarns is chosen from the group consisting of: 1:1, 3:2, 5:3, 2:1 or 3:1, when the weft binder yarns are included, and a pair of weft binder yarns counted as one paper side layer weft yarn.

15. A forming fabric according to claim 1 wherein the ratio of the number of paper side layer warp yarns to the number of machine side layer warp yarns is 1:1.

16. A forming fabric according to claim 1 wherein the ratio of the number of paper side layer warps to the number of machine side layer warps is 2:1.

17. A forming fabric according to claim 1 wherein the machine side layer weave is a 5/1 broken twill and the paper side layer is a 2/1 twill weave.

18. A forming fabric according to claim 1 wherein the machine side layer weave is a 5/1 broken twill and the paper side layer is a 2/1 satin weave.

19. A forming fabric according to claim 1 wherein the machine side layer weave is a 5/1 broken twill and the paper side layer weave is a 2/1 plain weave.

20. A forming fabric according to claim 1 wherein, at at least one locus in the paper side layer weave repeat pattern two pairs of weft binder yarns are adjacent to each other.

21. A forming fabric according to claim 1 wherein, at at least one locus in the paper side layer weave repeat pattern two pairs of binder yarns are separated by one paper side layer weft yarn.

22. A forming fabric according to claim 1 wherein, at at least one locus in the paper side layer weave repeat pattern two pairs of binder yarns are separated by two paper side layer weft yarns.

23. A forming fabric according to claim 1 wherein, at at least one locus in the paper side layer weave repeat pattern two pairs of binder yarns are separated by three paper side layer weft yarns.

* * * * *